US007748498B2

(12) United States Patent
Parker

(10) Patent No.: US 7,748,498 B2
(45) Date of Patent: Jul. 6, 2010

(54) ACCESS LADDER WITH PLUNGERS

(75) Inventor: Thomas W. Parker, Jamestown, PA (US)

(73) Assignee: Werner Co., Greenville, PA (US)

( * ) Notice: Subject to any disclaimer, the term of this patent is extended or adjusted under 35 U.S.C. 154(b) by 1228 days.

(21) Appl. No.: 11/254,941

(22) Filed: Oct. 19, 2005

(65) Prior Publication Data

US 2007/0084670 A1 Apr. 19, 2007

(51) Int. Cl.
*E06C 1/00* (2006.01)

(52) U.S. Cl. ..... 182/195; 182/77; 182/211

(58) Field of Classification Search ..... 182/195, 182/211, 77
See application file for complete search history.

(56) References Cited

U.S. PATENT DOCUMENTS

| | | | | |
|---|---|---|---|---|
| 2,993,561 | A * | 7/1961 | Watson | 182/195 |
| 3,061,042 | A * | 10/1962 | Giles | 182/195 |
| 4,429,766 | A * | 2/1984 | Alimbau | 182/195 |
| 4,457,391 | A * | 7/1984 | Alimbau | 182/164 |
| 5,495,915 | A * | 3/1996 | Weston et al. | 182/195 |
| 6,886,661 | B1 * | 5/2005 | Battenberg | 182/77 |
| 2004/0195043 | A1 * | 10/2004 | Johansson | 182/195 |

* cited by examiner

*Primary Examiner*—Alvin C Chin-Shue
(74) *Attorney, Agent, or Firm*—Ansel M. Schwartz

(57) ABSTRACT

An access ladder for accessing a ceiling from a floor. The ladder comprises a plurality of sections which telescope open and closed, and from a bottom section each section telescopes open to positively lock to the section below it with plungers that lock and unlock each section in sequence as the sections open and close, respectively. A method for using an access ladder for accessing a ceiling from a floor

12 Claims, 17 Drawing Sheets

ACCESS LADDER WITH PLUNGERS

FIELD OF THE INVENTION

The present invention is related to an access ladder. More specifically, the present invention is related to an access ladder having a plurality of sections which telescope open and closed, and from a bottom section each section telescopes open to positively lock to the section below it with plungers that lock and unlock each section in sequence as the sections open and close, respectively.

BACKGROUND OF THE INVENTION

Many houses today, whether new construction or older, have access holes in the ceiling in order to provide entry into the areas under the roof or into crawlspaces above the ceiling. These rectangular access holes are commonly located in hallways or in closets and are typically small, sometimes as small as 22 inches by 28 inches. It is standard practice for a person desiring to get into the area above the access hole to use a ladder. If this ladder is long enough to reach up through the access hole then it is likely too long to store in the house unless lying horizontally. If stored elsewhere, such as in a garage, the ladder is difficult to maneuver through the house. In any case, climbing up through the access hole is not convenient. Because of this inconvenience, potential storage space above the access hole remains unused.

The primary purpose of this invention is to provide an extendable easy to use ladder which is conveniently mounted in the access hole.

SUMMARY OF THE INVENTION

The present invention pertains to an access ladder for accessing a ceiling from a floor. The ladder comprises a plurality of sections which telescope open and closed, and from a bottom section each section telescopes open to positively lock to the section below it with plungers that lock and unlock each section in sequence as the sections open and close, respectively.

The present invention pertains to a method for using an access ladder for accessing a ceiling from a floor. The method comprises the steps of telescoping open from a bottom section of a plurality of sections each section in sequence so that each section positively locks to the section below it with plungers. There is the step of telescoping closed from a top section each section in sequence so that each plunger unlocks in sequence from the section below it.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
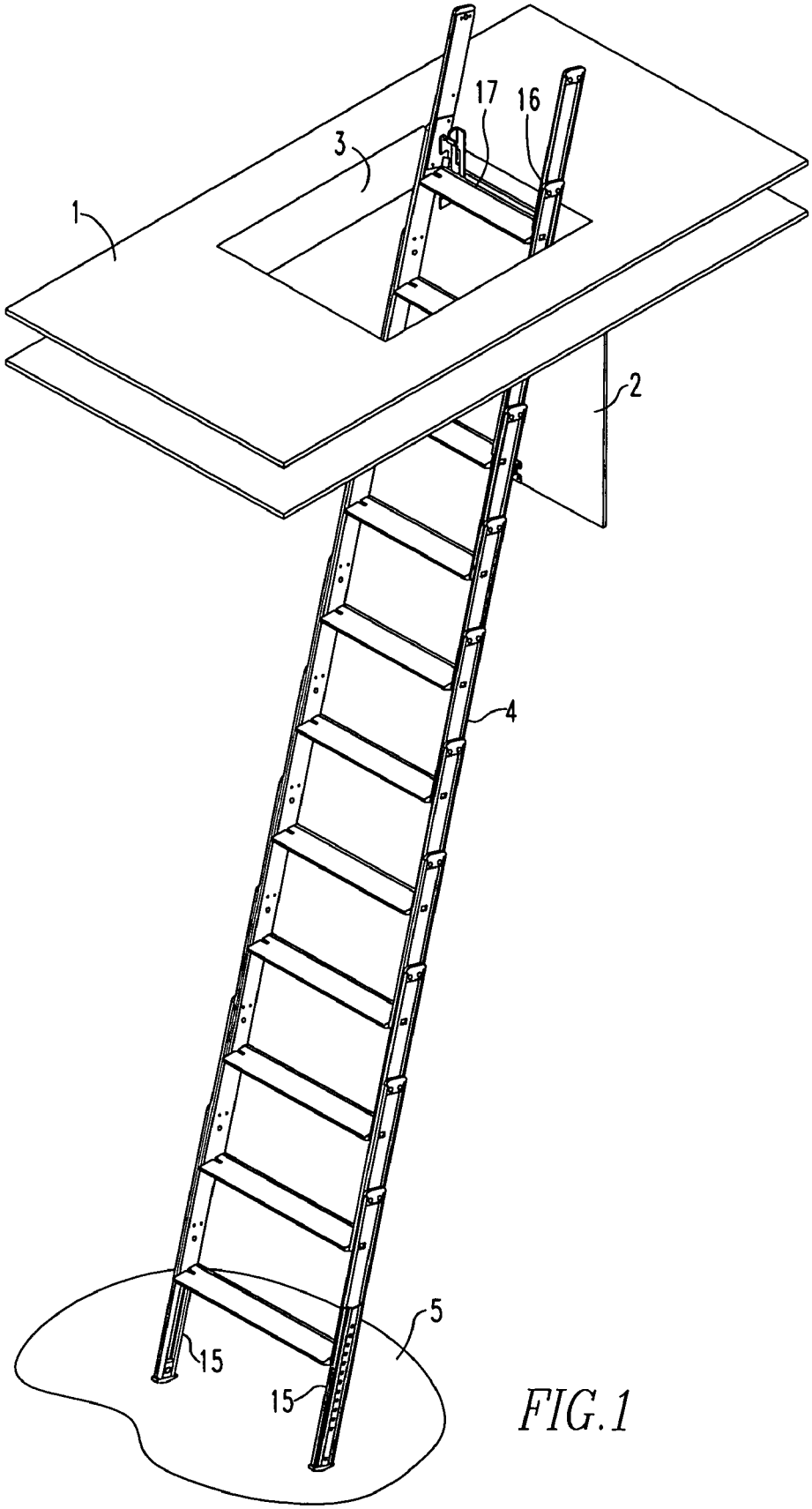
FIG. 1 is a perspective view of the access ladder of the present invention.

Referring now to the drawings wherein like reference numerals refer to similar or identical parts throughout the several views, and more specifically to FIG. 1 thereof, there is shown an access ladder 100 for accessing a ceiling 1 from a floor 5. The ladder 100 comprises a plurality of sections 25 which telescope open and closed, and from a bottom section 26 each section 25 telescopes open to positively lock to the section 25 below it with plungers 10 that lock and unlock each section 25 in sequence as the sections 25 open and close, respectively.

Figure 4:
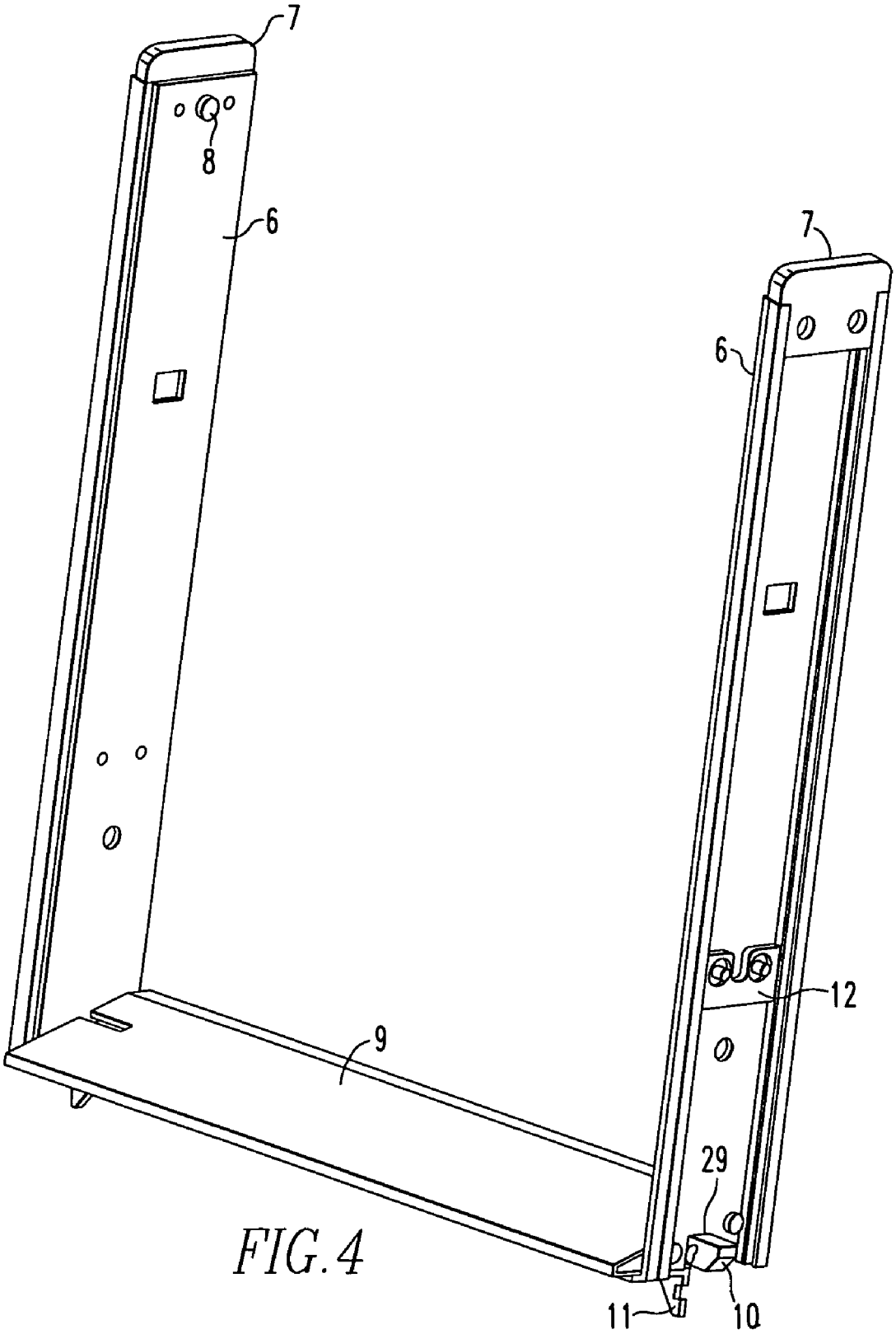
FIG. 4 is a perspective view of the section of the ladder.
Figure 9:
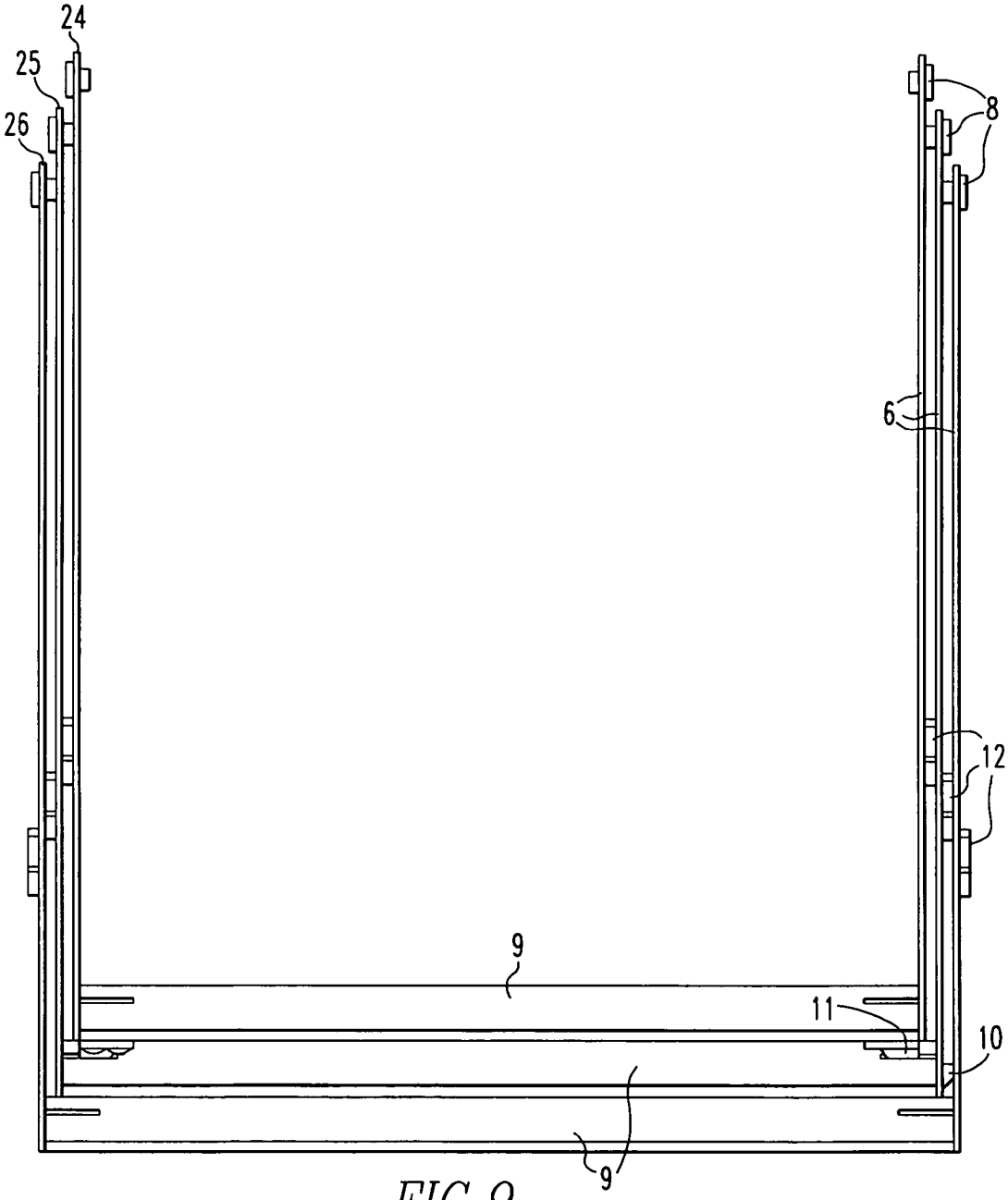
FIG. 9 shows sections of the ladder in a retracted position.

Preferably, each section 25 comprises a step, a first rail 6*a* and a second rail 6*b* extending from the step, and a first plunger 10*a* and a second plunger 10*b* extending from the step 9 to the first rail 6*a* and the second rail 6*b*, respectively, which engage with the first rail 6*a* and the second rail 6*b*, respectively, of the section 25 below it to lock with the section 25 below it, as shown in FIGS. 4 and 9. Each section 25 preferably includes a first plunger cam 11*a* and a second plunger cam 11*b* that extends from the step 9 and engages with the first plunger 10*a* and the second plunger 10*b*, respectively, of the section 25 below it to lock the section 25 below it closed.

Preferably, the plunger 10 has a spring 51 which exerts a force on the plunger 10 away from a center of the step 9. Each rail 6 preferably has a stop pin 8 disposed adjacent the top of the rail 6 and a stop 12 disposed adjacent the center of the rail. Each section 25 is pulled down until its stop pin 8 has contacted the stop 12 of the section 25 above it. Preferably, the plurality of sections 25 include a top section 24 which pivotally connects to the ceiling 1. The bottom section 26 preferably has two legs 15 which contact the floor 5. Preferably, the two legs 15 of the bottom section 26 are adjustable in length.

Figure 8:
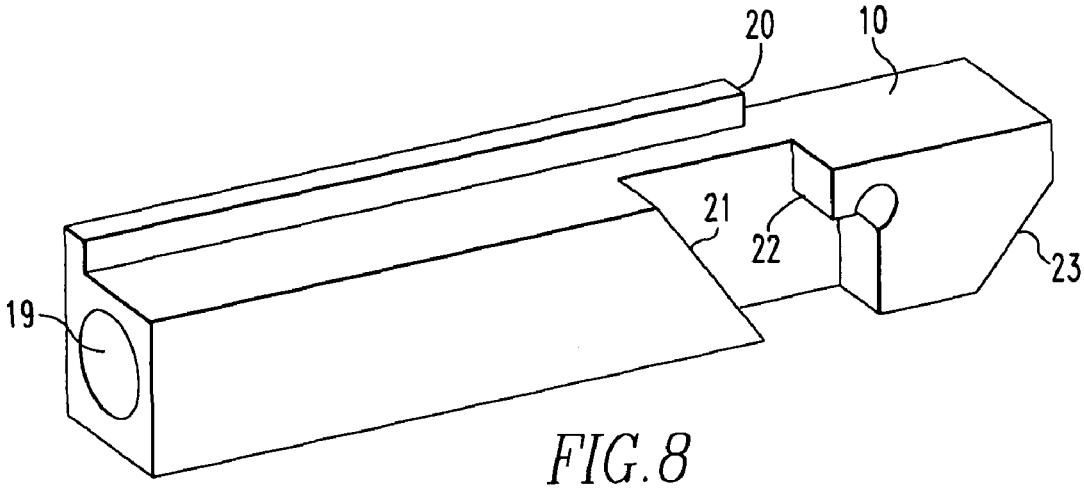
FIG. 8 is a perspective view of a plunger.
Figure 12:
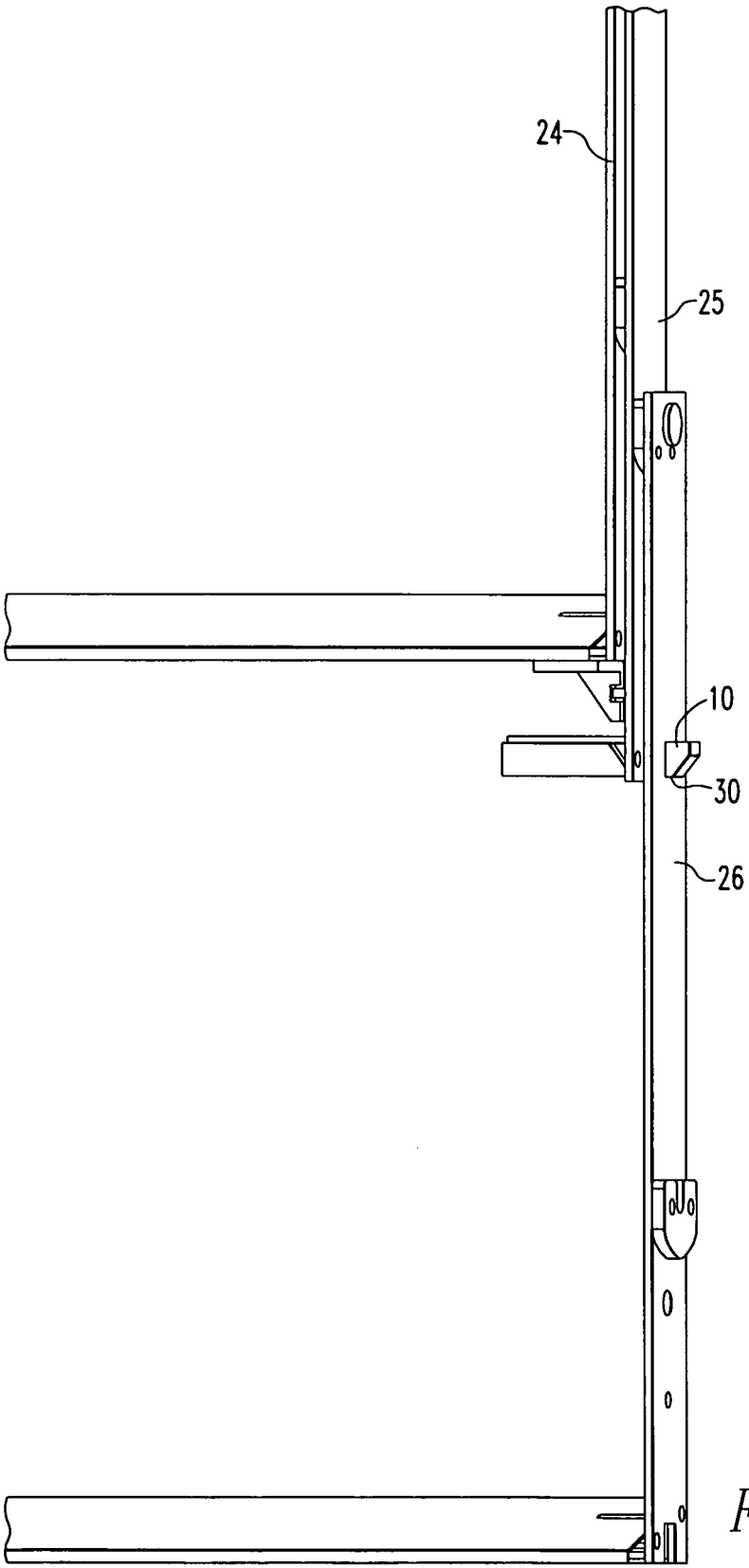
FIG. 12 shows a section being pulled down by a section below it.
Figure 18:
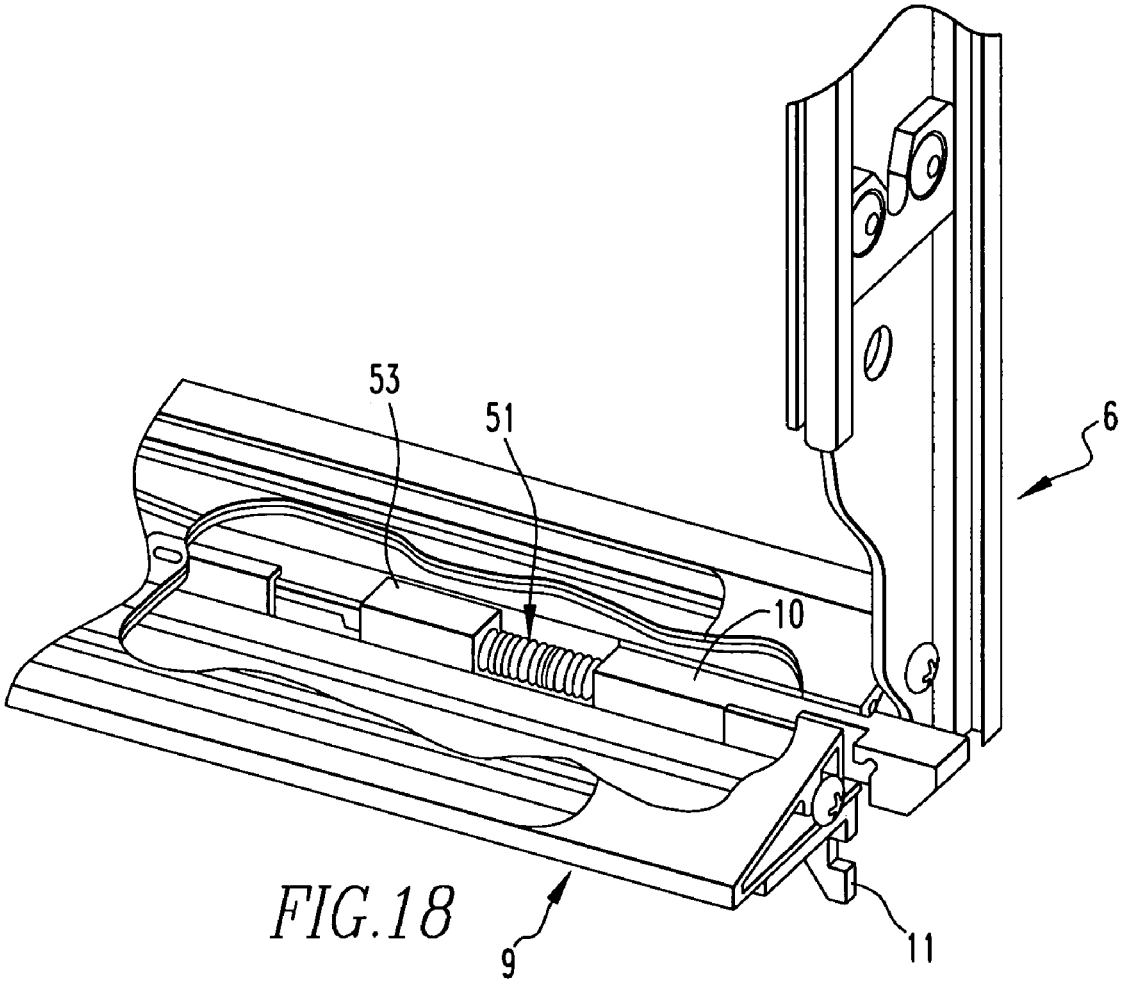
FIG. 18 shows the plunger spring pushing against the plunger spring stop.

Each rail 6 preferably has an opening 30 into which a plunger 10 of the section 25 above the rail moves as the rail moves downward to lock the section 25 of the rail 6 in place against a downward force, as shown in FIG. 12. Preferably, the plunger has a hole 19 in which the spring 51 is disposed, and a rib 20 which prevents the plunger from escaping the step, as shown in FIG. 8. The plunger preferably has a cam slope 21 and a hook 22 which interacts with the plunger cam 11 when the plunger is pushed back from the opening 30 to lock the section 25 of the plunger in place when the sections 25 are closed. Preferably, the plunger has a beveled edge 23 against which the rail of the section 25 below the plunger pushes to force the plunger back from the opening 30 when the sections 25 are being closed. There is preferably a plunger stop 53 disposed in each step 9 adjacent to each plunger hole 19 against which the spring 51 in the plunger hole 19 pushes, as shown in FIG. 18.

The present invention pertains to a method for using an access ladder 100 for accessing a ceiling 1 from a floor 5. The method comprises the steps of telescoping open from a bottom section 26 of a plurality of sections 25 each section 25 in sequence so that each section 25 positively locks to the section 25 below it with plungers 10. There is the step of telescoping closed from a top section 24 each section 25 in sequence so that each plunger unlocks in sequence from the section 25 below it.

Preferably, each section 25 comprises a step, a first rail 6*a* and a second rail 6*b* extending from the step, and a first plunger 10*a* and a second plunger 10*b* extending from the step 9 to the first rail 6*a* and the second rail 6*b*, respectively, and the telescoping open step includes the step of engaging the first plunger 10*a* and the second plunger 10*b* with the first rail 6*a* and the second rail 6*b*, respectively, of the section 25 below it to lock with the section 25 below it. Each section 25 preferably includes a first plunger cam 11*a* and a second plunger cam 11*b* that extends from the step, and the telescoping open step includes the step of engaging the first plunger cam 11*a* and a second plunger cam 11*b* with the first plunger 10*a* and the second plunger 10*b*, respectively, of the section 25 below it to lock the section 25 below it closed.

Preferably, the plunger has a spring 51 and the telescoping open step includes the step of exerting a force with the spring 51 on the plunger away from a center of the step. Each rail preferably has a stop pin 8 disposed adjacent the top of the rail and a stop 12 disposed adjacent the center of the rail, and the telescoping open step includes the step of pulling each section 25 down until its stop pin 8 has contacted the stop 12 of the section 25 above it. Preferably, there is the step of pivoting the top section 24 which is pivotally connecting to the ceiling 1.

The bottom section 26 preferably has two legs 15, and the telescoping open step includes the step of contacting the two legs 15 with the floor 5. Preferably, the telescoping open step includes the step of adjusting the length of the two legs 15 of the bottom section 26. Each rail preferably has an opening 30 and the telescoping open step includes the step of moving a plunger of the section 25 above the rail into the opening 30 of the rail as the rail moves downward to lock the section 25 of the rail in place against a downward force.

Preferably, there is the step of preventing the plunger from escaping the step 9 with a rib 20 of the plunger. The plunger preferably has a cam slope 21 and a hook 22, and the telescoping closed step includes the step of interacting the cam slope 21 and the hook 22 with the plunger cam 11 when the plunger is pushed back from the opening 30 to lock the section 25 of the plunger in place when the sections 25 are closed. Preferably, the plunger has a beveled edge 23, and the telescoping closed step 9 includes the step of pushing the beveled edge 23 of the plunger against the rail of the section 25 below the plunger to force the plunger back from the opening 30 when the sections 25 are being closed. There is preferably a plunger stop 53 disposed in each step 9 adjacent to each plunger hole 19 and there is the step of pushing the spring 51 in a plunger hole 19 against the plunger stop 53.

In the operation of the preferred embodiment, the ladder consists of several sections which telescope relative to each other. FIG. 1 shows the ladder fully extended. 1 is a section of the ceiling as seen from above. 2 is a door which is separate from the ladder and which opens and closes independently. 3 is the access hole opening in the ceiling. 25 is one of the several sections of the ladder. 5 is the floor.

Figure 2:
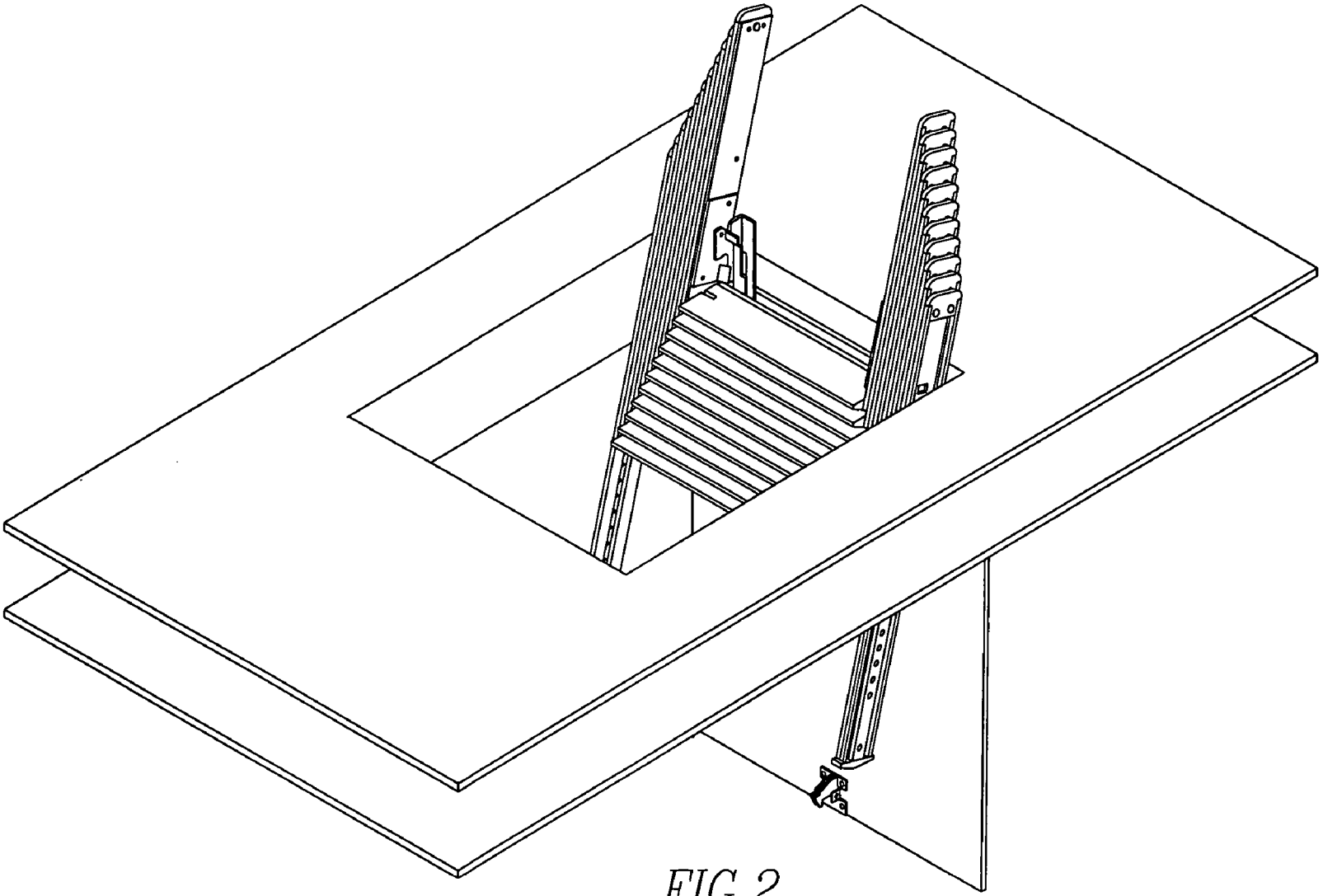
FIG. 2 is a perspective view of the ladder in a closed state.

FIG. 2 shows the ladder after telescoping to its retracted position.

Figure 3:
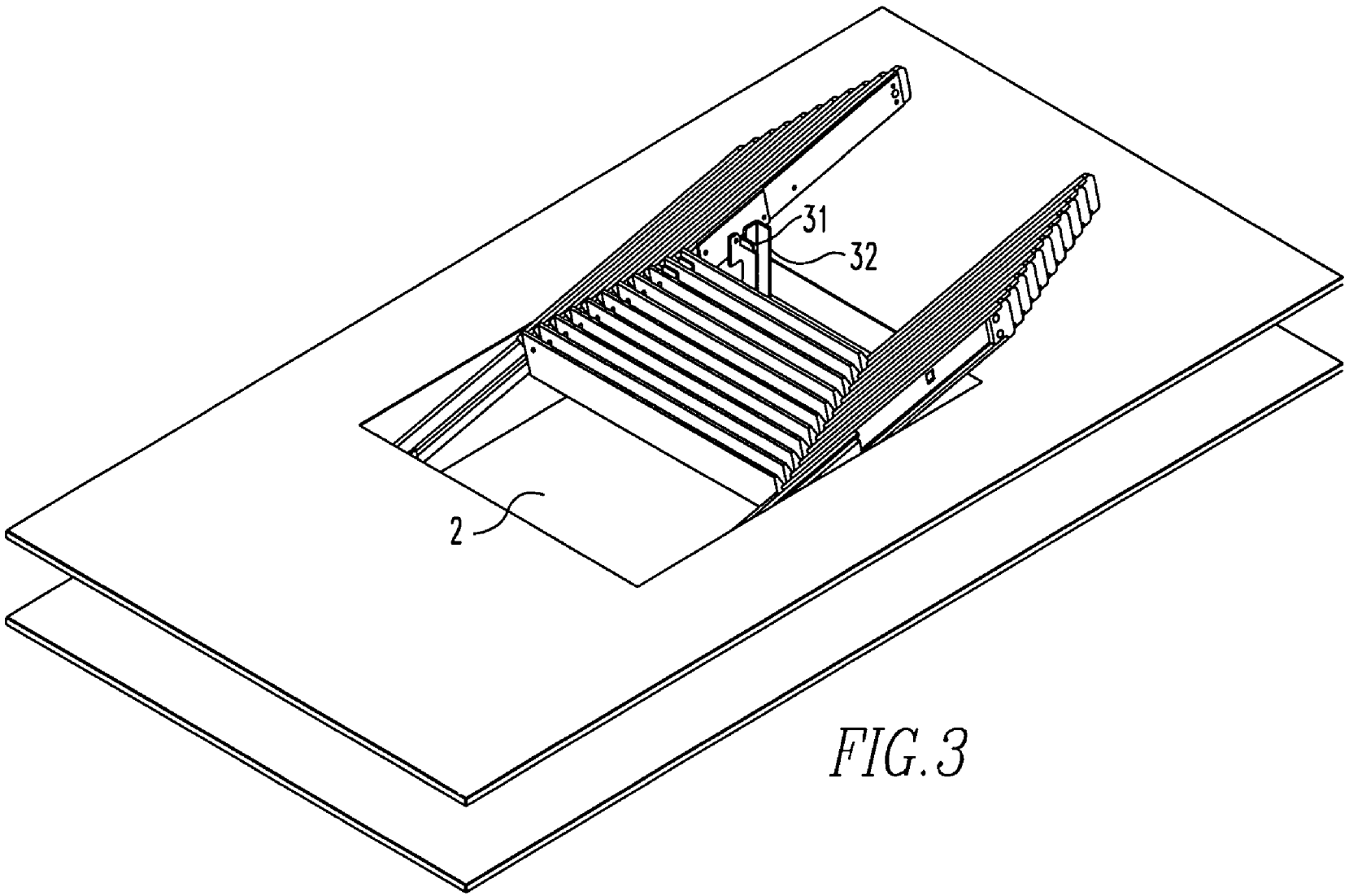
FIG. 3 is a perspective view of the ladder in a closed state.

FIG. 3 shows the retracted ladder after it has been rotated to its stowed position. This rotational motion is completely independent of the extending and retracting motion. The door 2 is shown in its closed position.

FIG. 4 shows a typical section of the ladder. 6 is a rail, 7 is a rail cap, 8 is a stop pin, 9 is the step, 10 is a plunger, 11 is a plunger cam, 12 is a stop. Except for the step, there are two of each of these parts per section. The sections of the ladder are identical except for the width of the step in each section. The narrowest step is at the top and the widest step is at the bottom. This can be seen in FIG. 2.

Figure 5:
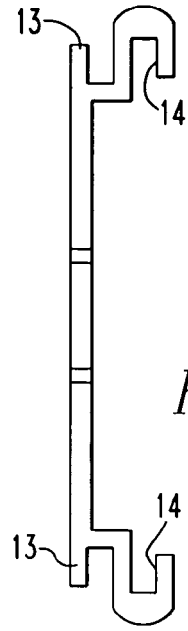
FIG. 5 shows an end view of a rail.

FIG. 5 shows an end view of a typical rail. The areas 13 and 14 are provided so that one rail will interlock with an adjacent rail to form a rigid structure and yet allow relative sliding motion to occur in the direction of the rail's long axis as when extending or retracting the ladder.

Figure 6:
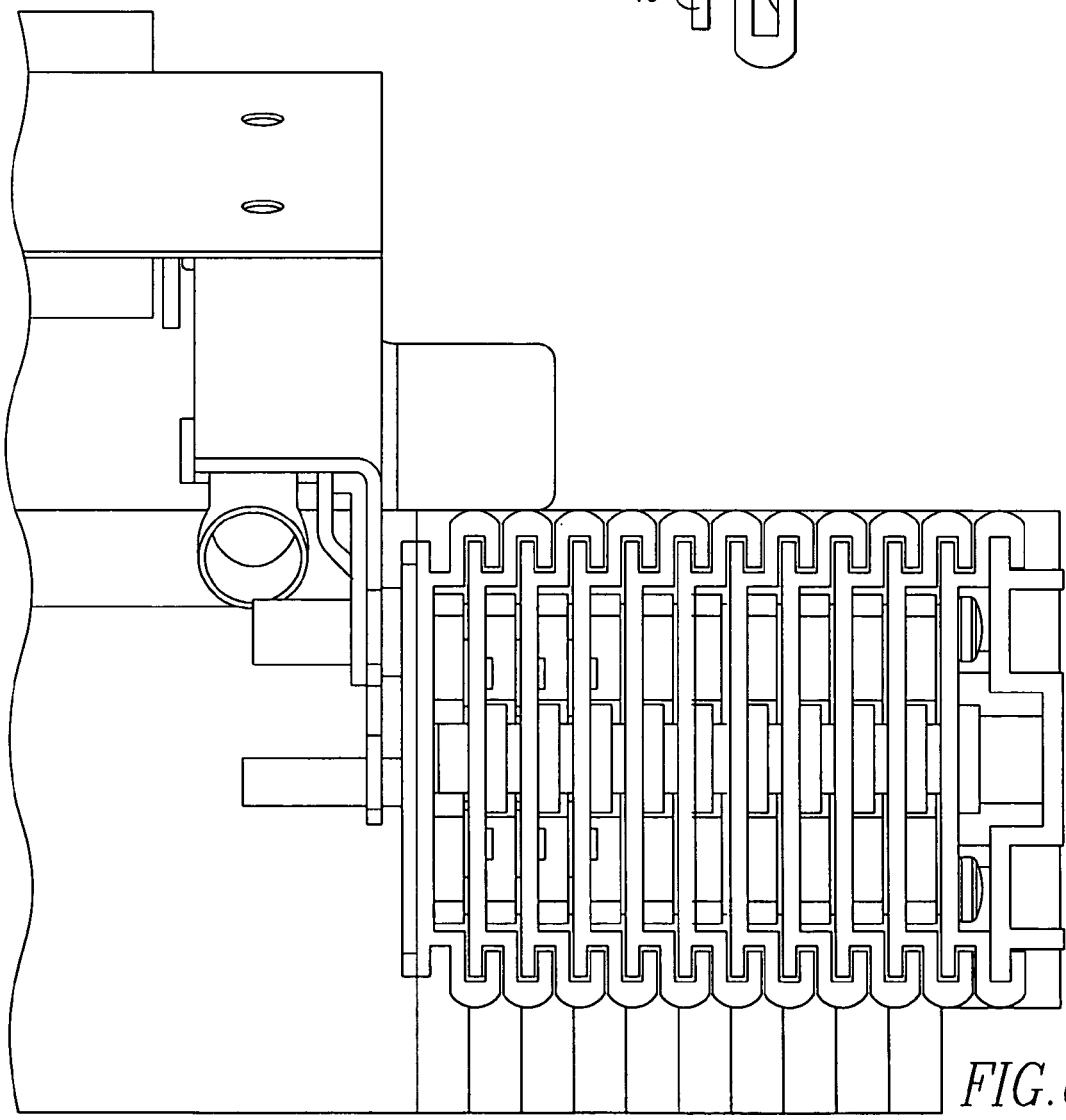
FIG. 6 shows a view of the ladder as seen from the top and looking down the right side rails.

FIG. 6 shows a view of the ladder as seen from the top end looking down the right side rails. The right side rail caps have been removed to show the interlocking of the rails.

As seen in FIG. 1, the bottom section 26*a* of the ladder has two legs 15 attached. These legs have multiple holes which allow them to be attached to the bottom section in various positions to accommodate various floor to ceiling distances. Additionally, the top section has two brackets 16 attached which allow the ladder to be pivotally connected to the header assembly 17 which in turn is attached directly to one end of the access hole.

Figure 7:
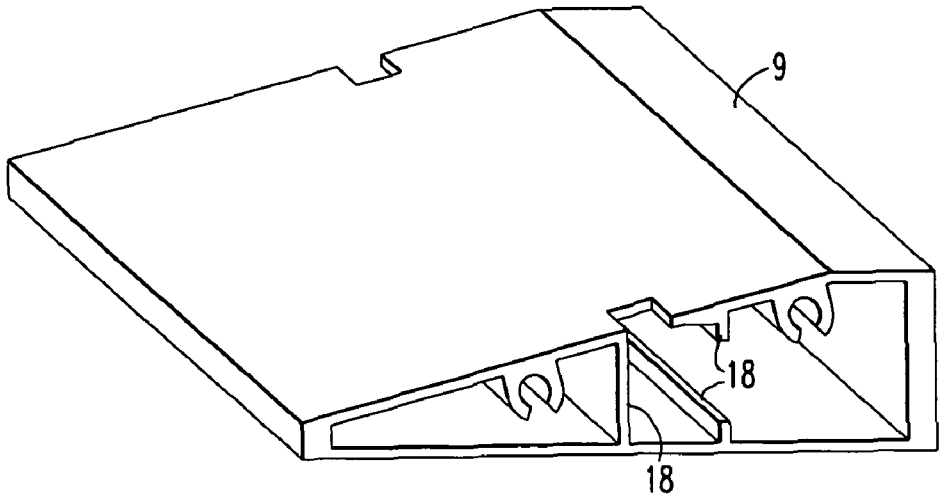
FIG. 7 is an end view of a step.

FIG. 7 is an end view of a typical step 9. The step is made from a hollow aluminum extrusion. A web and abutments 18 are provided to guide the plunger. The plunger 10 is seen in FIG. 8. The plunger has a square cross-section with several features. A hole 19 in the back of the plunger partially houses a compression spring. A rib 20 prevents the plunger from escaping from the step when it is assembled. A cam slope 21 is designed to interact with the plunger cam 11 in FIG. 4 as well as a hook 22. The front end of the plunger has a beveled edge 23.

Extending and Retracting the Ladder

The plungers and plunger cams in each section interact in such a way that the ladder is constrained to extend one section at a time beginning with the lowest section and to retract one section at a time beginning with the section immediately below the uppermost section.

FIG. 9 shows three simplified sections of the ladder in the retracted position. Each section are shown with rails 6, stop pins 8, stops 12, and steps 9. The first, second and third sections are 24, 25, and 26. respectively. The first section is assumed to be attached to the access opening in the ceiling. A single plunger 10 is shown in the step 9 of the second section 25. A single plunger cam 11 is shown attached to the step 9 of the first section 24.

Figure 10:
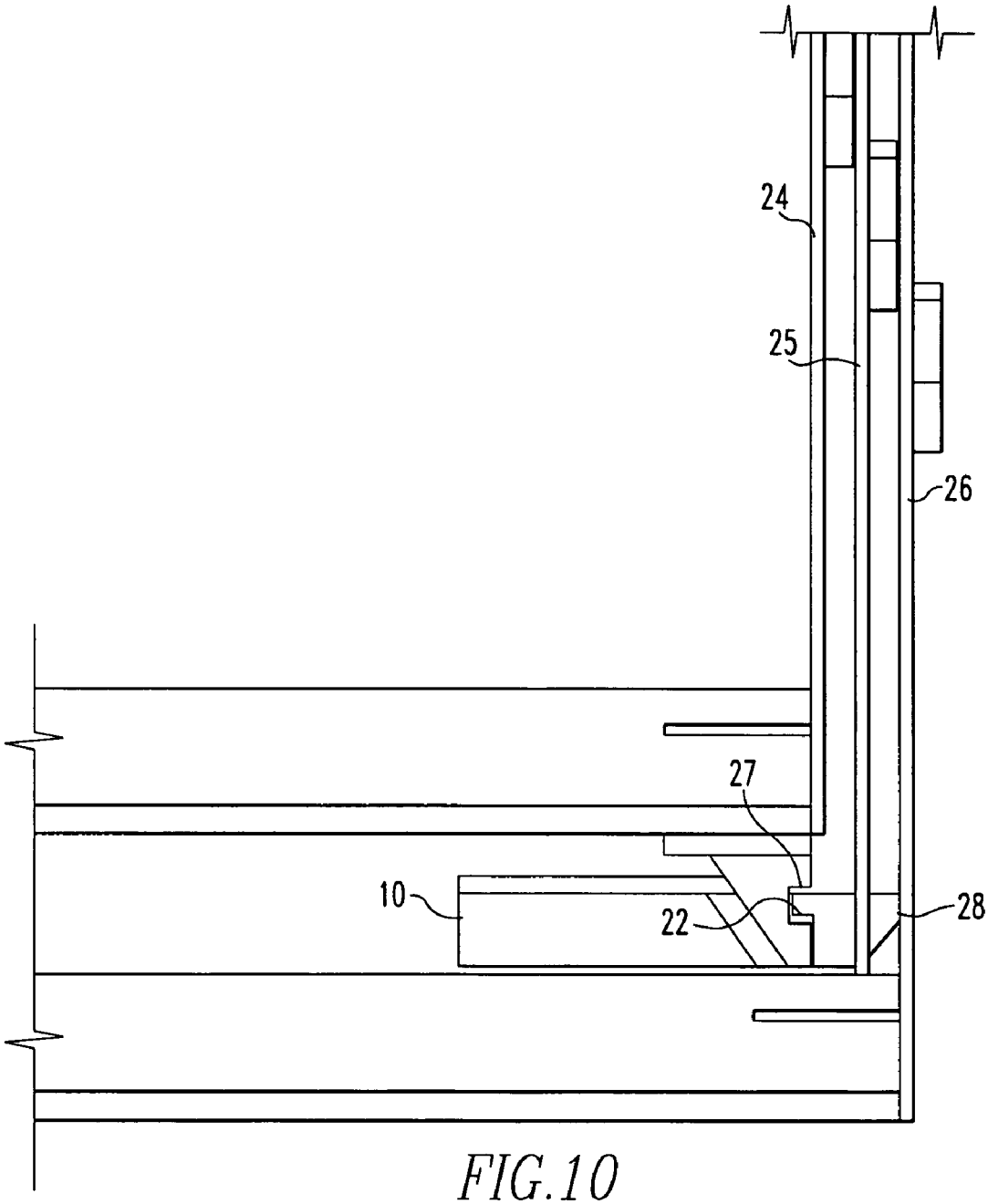
FIG. 10 shows the plunger extending through a section below it.

In FIG. 10, the step of the second section 25 has been rendered invisible so the plunger 10 can be fully seen. The plunger spring is also not shown but can be assumed to be exerting a force on the plunger tending to drive it to the right. Notice that when the sections are in this position the nose of the plunger 28 is protruding through an opening 29 (see FIG. 4) in the rail of the second section and is up against the rail of the third section 26. Also, the hook of the plunger 22 engages the notch in the plunger cam 27. Thus, the second section is locked to the first section while the third section is free to be pulled down, the only resistance being supplied by the nose of the plunger 28 rubbing against the inside surface of the rail of the third section.

To extend the ladder, the user would pull down on the lowest section.

Figure 11:
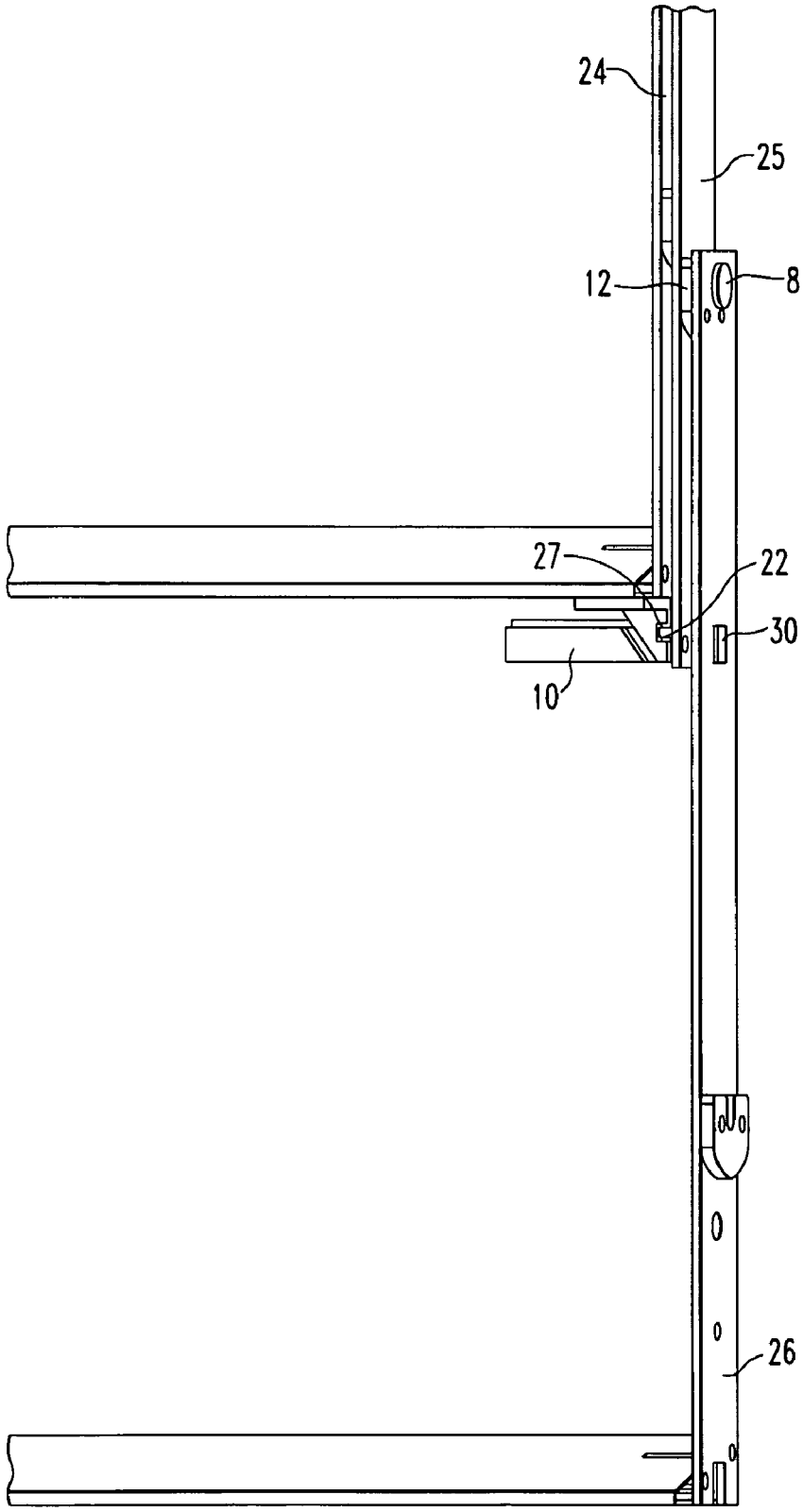
FIG. 11 shows a section extended relative to a section above it.

In FIG. 11 the third (lowest) section 26 has been pulled down relative to the second section until the stop pin 8 on the third section has contacted the stop 12 on the second section. At the same time the square opening 30 in the rail of the third section has lined up with the plunger 10. The plunger is now free to move to the right due to the force of the plunger spring, causing the hook and notch (22 and 27) to disengage. Note, the primary purpose of the stop pin 8 and stop 12 is to make sure that no section can extend too far relative to the section above it, giving the plunger opportunity to move into proper engagement under the influence of the plunger spring.

In FIG. 12, the second section 25 is being pulled down by the third section 26. The plunger 10 has fully engaged the hole 30 in the rail of the third section. Thus, the second section is now locked to the third section and moves relative to the first section 24. This sequence is repeated for each of the sections of a complete ladder, each section releasing itself from the section above it and being locked to the section below it, until the ladder is fully extended and the feet of the ladder reach the floor. The legs of the ladder will have been adjusted so that the spacing between the uppermost step belonging to the section which is attached to the access hole and the step of the section just below it is the same as the spacing between the steps of each of the sections which have become locked together by the actions of the plungers. The uppermost section is an exception in that it does not have plungers to lock it to the section immediately below it since, whereas the weight of the user is ultimately supported by the floor through the locking action of the plungers when he/she is standing on any but the uppermost step, the weight of the user standing on the uppermost step is supported through the attachment of that section to the access hole.

In summary, when in the fully extended position, each section (except for the uppermost section) is locked by the plunger to the section beneath it.

Figure 13:
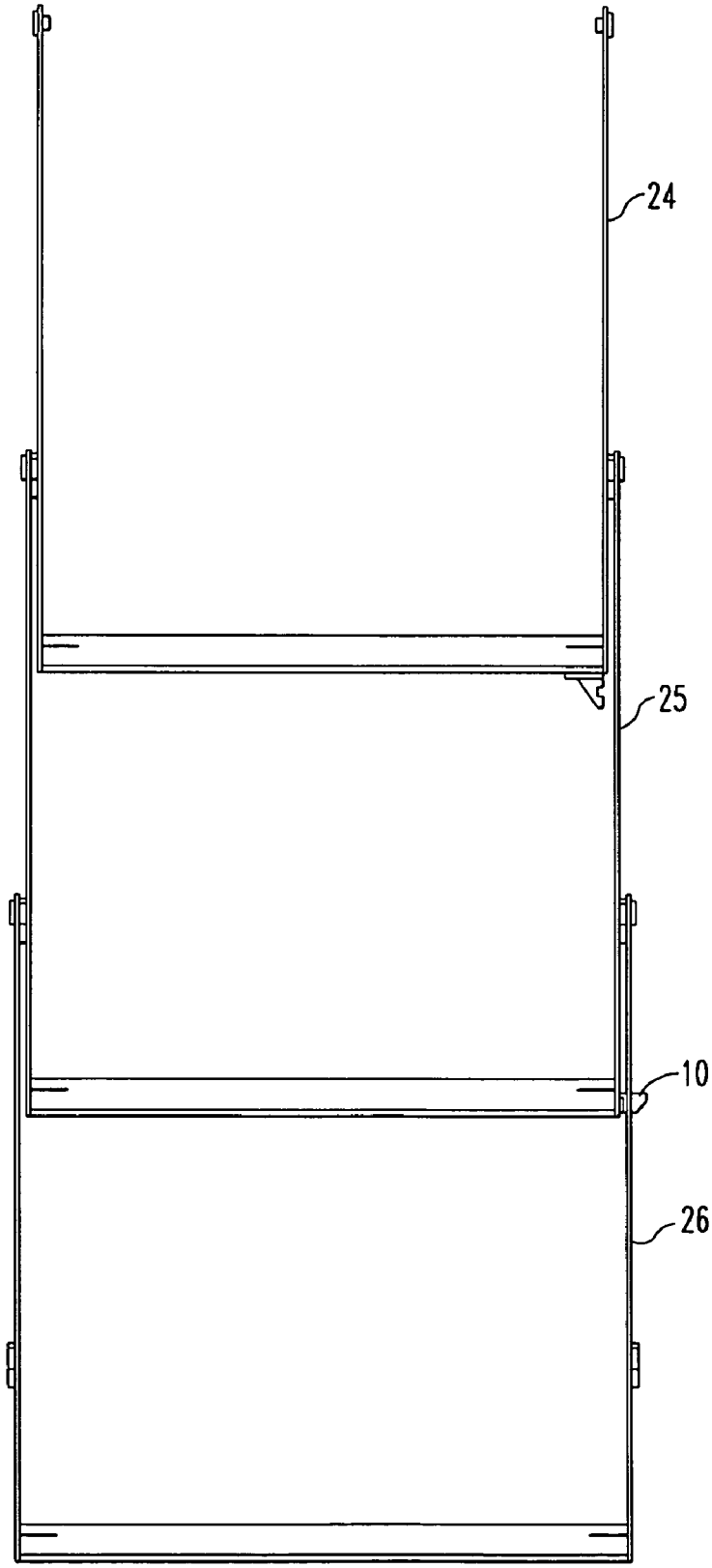
FIG. 13 shows several sections of the ladder in an open state.

FIG. 13 represents the fully extended simplified ladder about to be retracted. The first section 24 is assumed to be attached to the access hole and the second and third sections 25 and 26 are locked together by the plunger 10 which is mounted in the step of the second section.

To retract the ladder, the user would grip any of the lower sections and begin pushing the sections upward. In the simplified ladder shown in FIG. 13, sections 25 and 26 would slide up together relative to section 24.

Figure 14:
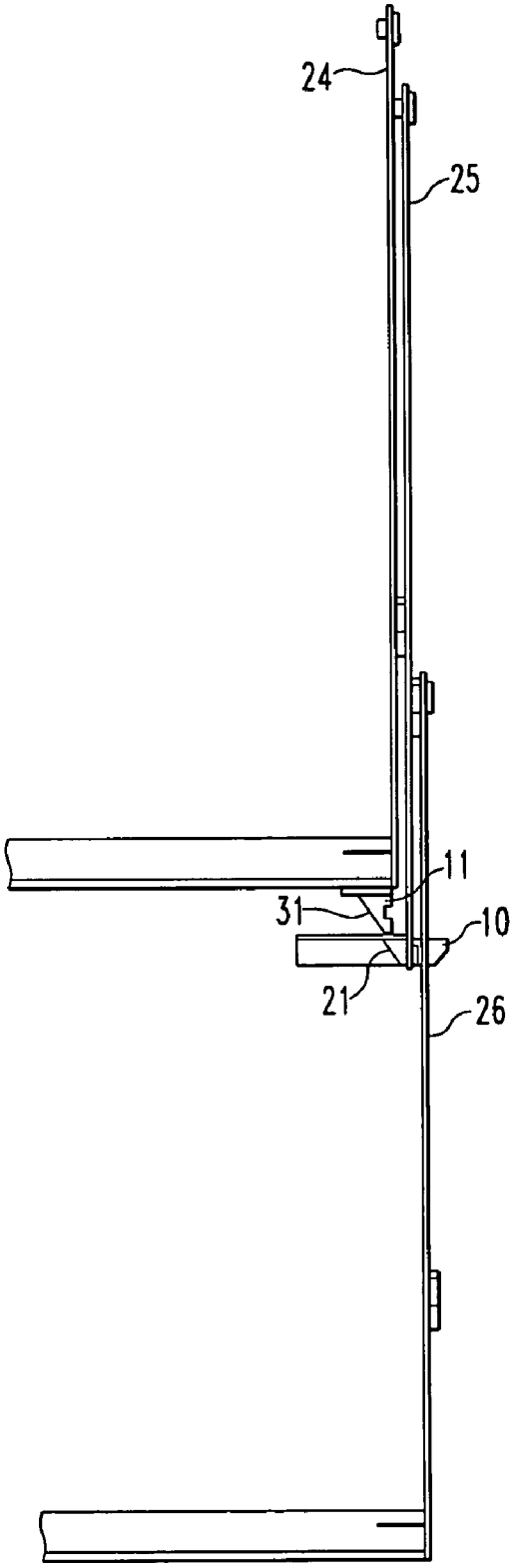
FIG. 14 shows a section reaching the end of its retraction relative to a section above it.

FIG. 14 shows the simplified ladder just as section 25 is reaching the end of its retraction relative to section 24. Again, the step of section 25 has been rendered invisible to show the action of the plunger. The cam slope 21 on the plunger 10 is just coming into contact with the corresponding slope 31 on the plunger cam 11. Continued upward motion of section 25 relative to section 24 will cause the plunger to move to the left against plunger spring force.

Figure 15:
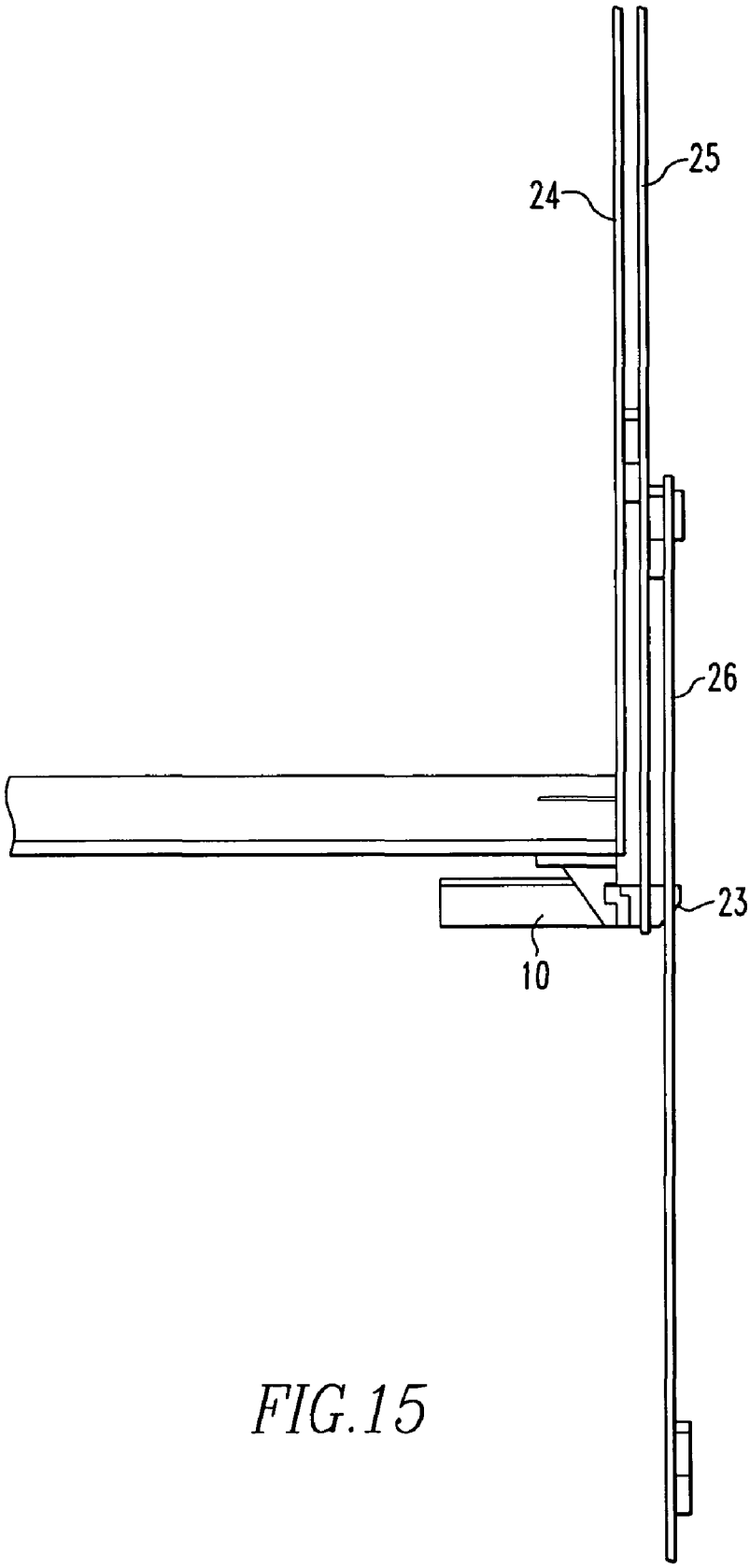
FIG. 15 shows two sections having risen relative to another section as far as they can and the plunger nearly fully retracted.
Figure 16:
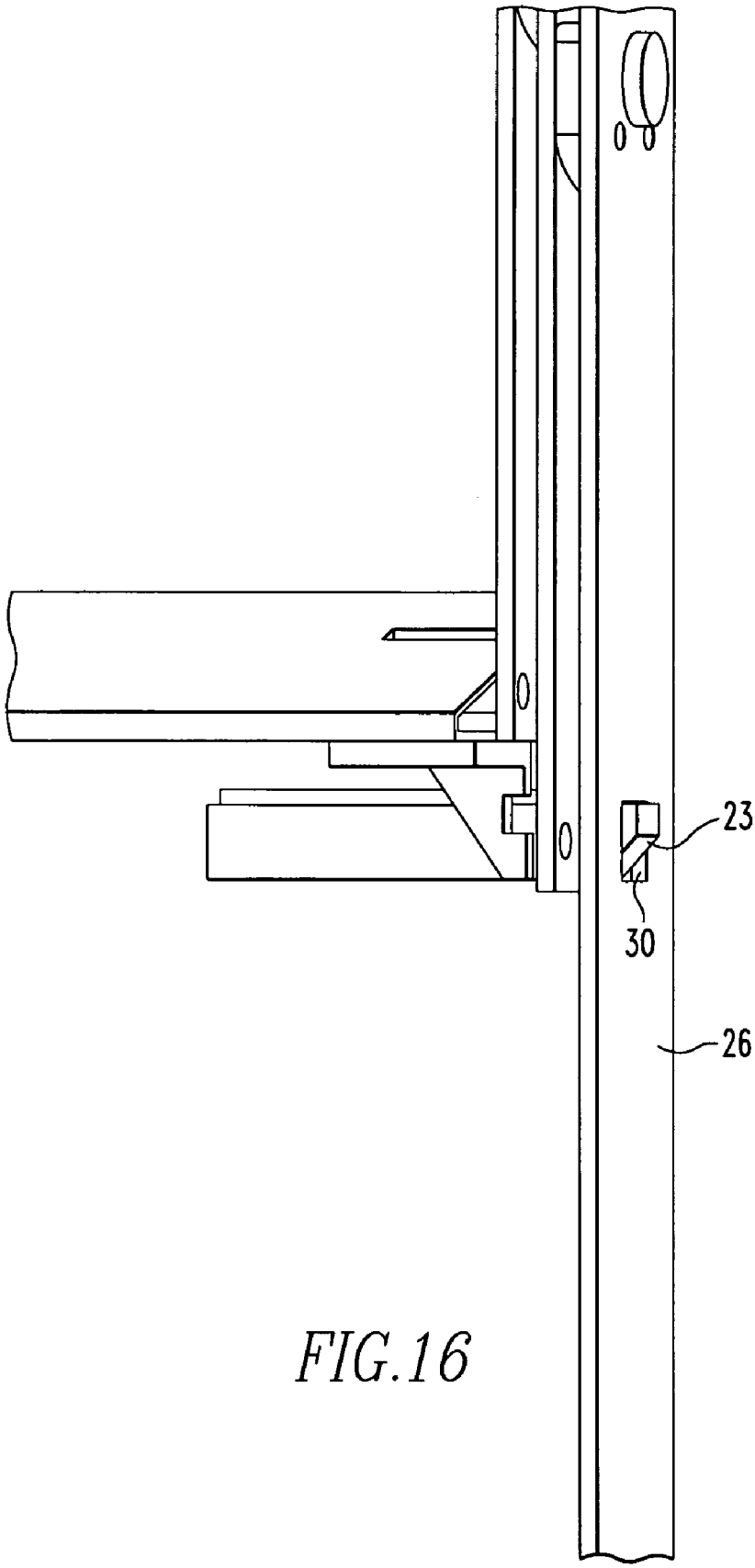
FIG. 16 shows the beveled nose of the plunger protruding in the hole of the rail below it.

In FIG. 15 sections 25 and 26 have risen relative to section 24 as far as they can and the plunger 10 has been nearly fully retracted. The beveled nose 23 of the plunger is still protruding in the hole 30 of the rail of section 26. See FIG. 16. At this point section 26 may be pushed up further, the hole 30 in conjunction with the beveled nose 23 of the plunger causing the plunger to be forced even further to the left.

Figure 17:
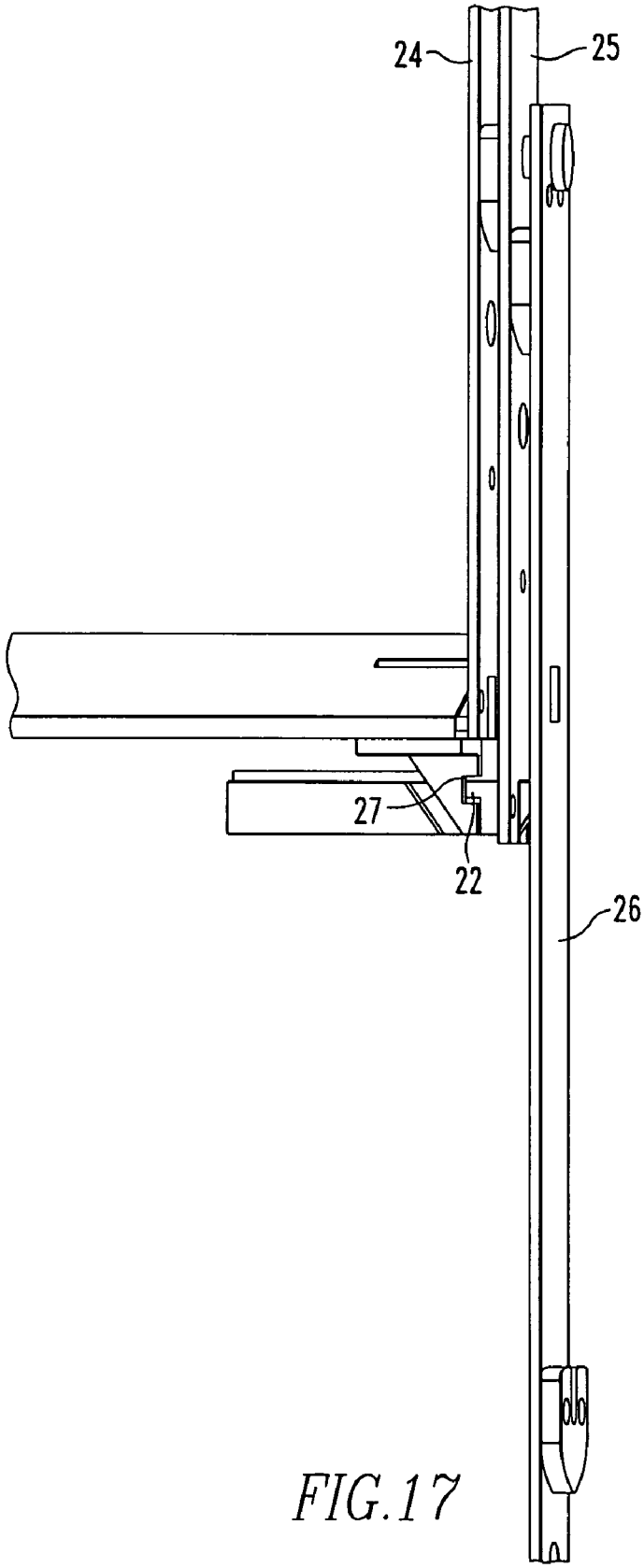
FIG. 17 shows the hook of the plunger engaged with the notch of the plunger cam below it.

FIG. 17 shows how the hook 22 of the plunger has engaged the notch 27 of the plunger cam, thus locking section 25 to section 24. Section 26 is now free to be retracted completely until the simplified ladder is as seen in FIG. 9.

This retracting sequence is repeated until all the sections have been pushed up into the retracted position.

In summary, when in the fully retracted position, each section (except for the bottom section) is locked by the plunger to the section above it.

Moving the Ladder to and from the Stowed Position

Figure 3A:
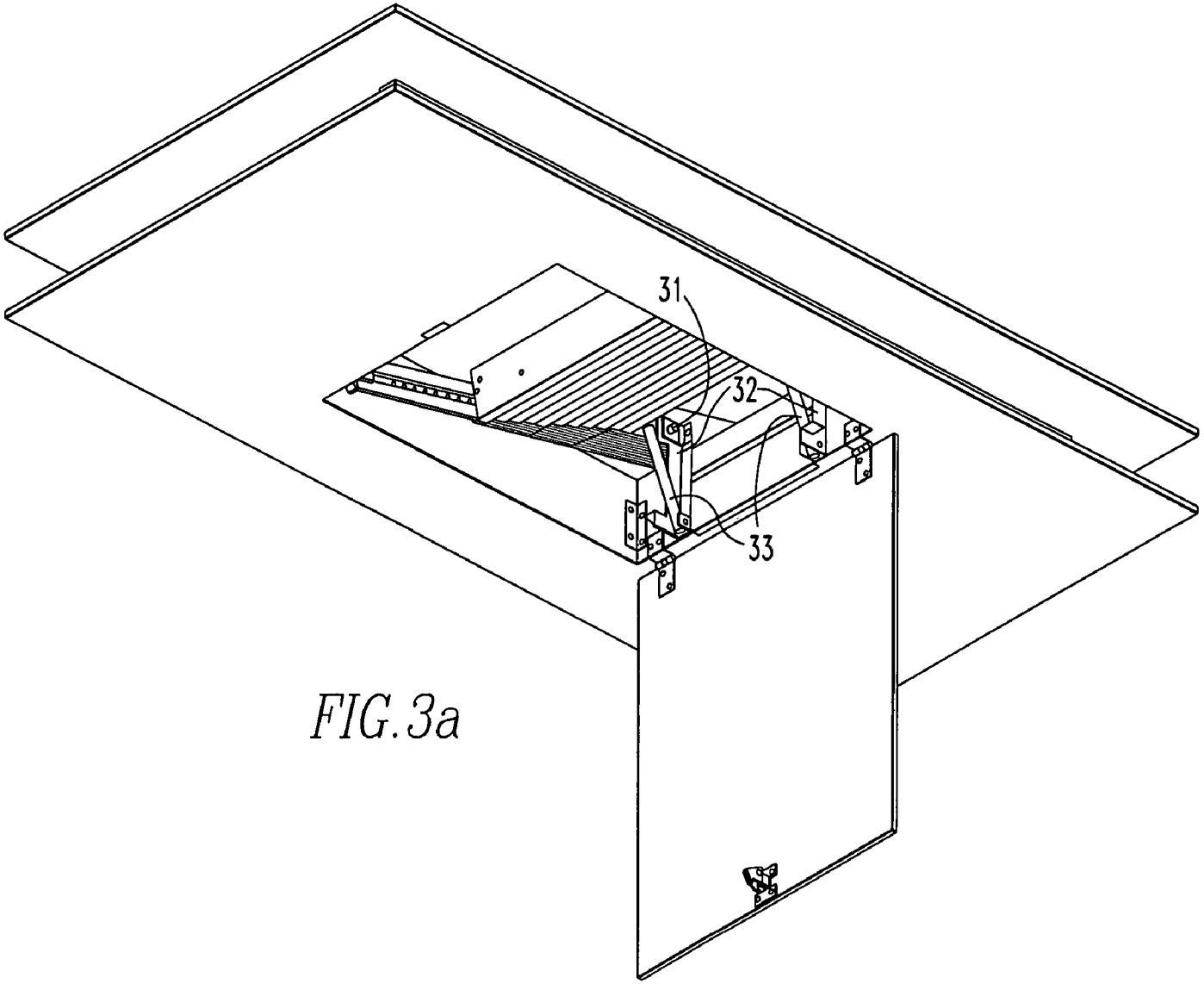
FIG. 3*a* is a perspective view of the ladder in a closed state from below.

FIGS. 3 and 3A are two views of the ladder in the stowed position. The pivot pins 31 are attached to the uppermost ladder section and pivot in the mounting brackets 32. Two spring tubes 33 containing compression coil springs are connected to the mounting brackets and the uppermost section. The spring forces in the spring tubes are just sufficient to hold the ladder in the stowed position. The user has merely to reach up by hand or with a hooked extension pole and by overcoming the force of the spring tubes pull the ladder down to the position shown in FIG. 2. The ladder can be pushed from the position in FIG. 2 back to the position in FIG. 3 to stow it prior to shutting the door.

Other Applications

The function of the plungers described above which provide a means of locking multiple sections of a ladder in retracted or extended positions can be applied to other climbing products.

A portable ladder can be built having multiple sections which the user would extend prior to use. When retracted, the ladder would be compact and convenient to move and when extended would provide a safe and secure means of climbing.

A stepladder could also be built having multiple sections on the front or climbing side and the back side as well. Such a stepladder would be very compact when retracted and easy to store.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An access ladder for accessing a ceiling from a floor comprising:

a plurality of sections which telescope open and closed, and from a bottom section each section telescopes open to positively lock to the section below it with plungers that lock and unlock each section in sequence as the sections open and close, respectively; and a header assembly attached to the ceiling, a top section of the plurality of sections pivotally connected to the header assembly, wherein each section comprises a step, a first rail and a second rail extending from the step, and a first plunger and a second plunger extending from the step to the first rail and the second rail, respectively, which engage with the first rail and the second rail, respectively, of the section below it to lock with the section below it; each section includes a first plunger cam and a second plunger cam attached to the underside of the step, each plunger cam extends below the step and engages with the first plunger and the second plunger, respectively, of the section below it to lock the section below it closed.

2. A ladder as described in claim 1 wherein the first rail and the second rail of the top section each include a bracket pivotally attached to the header assembly.

3. A ladder as described in claim 2 including two compression springs, with one of the two springs attached to each bracket, respectively, and to the top section, to hold the ladder in a stowed position in the ceiling.

4. A ladder as described in claim 3 wherein the plunger has a spring which exerts a force on the plunger away from a center of the step.

5. A ladder as described in claim 4 wherein each rail has a stop pin disposed adjacent the top of the rail and a stop disposed adjacent the center of the rail, each section is pulled down until its stop pin has contacted the stop of the section above it.

6. A ladder as described in claim 5 wherein the bottom section has two legs which with multiple holes contact the floor when the ladder is in an extended position.

7. A ladder as described in claim 6 wherein the two legs of the bottom section are adjustable in length.

8. A ladder as described in claim 7 wherein each rail has an opening into which a plunger of the section above the rail moves as the rail moves downward to lock the section of the rail in place against a downward force.

9. A ladder as described in claim 8 wherein the plunger has a hole in which the spring is disposed, and a rib which prevents the plunger from escaping the step.

10. A ladder as described in claim 9 wherein the plunger has a cam slope and a hook which interacts with the plunger cam when the plunger is pushed back from the opening to lock the section of the plunger in place when the sections are closed.

11. A ladder as described in claim 10 wherein the plunger has a beveled edge against which the rail of the section below the plunger pushes to force the plunger back from the opening when the sections are being closed.

12. A ladder as described in claim 11 including a plunger stop disposed in each step adjacent to each plunger hole against which the spring in the plunger hole pushes.

* * * * *